United States Patent [19]

Schroer

[11] 4,393,626

[45] Jul. 19, 1983

[54] TOOLHOLDER FOR SUPPORTING THIN ROTARY TOOLS

[75] Inventor: George A. Schroer, Cincinnati, Ohio

[73] Assignee: Cincinnati Milacron Inc., Cincinnati, Ohio

[21] Appl. No.: 319,577

[22] Filed: Nov. 9, 1981

[51] Int. Cl.[3] ..... B24B 41/04

[52] U.S. Cl. ..... 51/168; 409/234; 83/666

[58] Field of Search ..... 51/168, 209 R; 409/232, 409/234; 83/666; 144/222, 236, 90 A

[56] References Cited

U.S. PATENT DOCUMENTS

| | | | |
|---|---|---|---|
| 726,378 | 4/1903 | Tucker | 51/168 |
| 1,775,004 | 9/1930 | Steiner | 51/168 |

*Primary Examiner*—Roscoe V. Parker

*Attorney, Agent, or Firm*—Thomas M. Farrell

[57] ABSTRACT

A toolholder for supporting thin rotary tools is disclosed, utilizing first and second tool rings having flange portions for respectively clamping and driving the sides of a rotary tool such as a thin grinding wheel, wherein the respective tool rings have generally circular tool support sections adjacent to their flange portions, and the circular tool support sections are relieved so as to form facial teeth or lugs on the two rings, and the respective teeth of the one ring engage the tooth spaces of the other ring and vice versa, when the rings are clamped against a thin tool. The first tool ring is adapted to locate and drive with a rotatable tool spindle, and the second tool ring is adapted to be carried in a concentric manner with the first ring and means is provided for clamping the rings together and enmeshing the respective tool support sections, so that a tool having a thickness equal to or less than the combined length of each tool support section of the respective rings may be clamped and supported on a substantially continuous bore support surface.

1 Claim, 3 Drawing Figures

TOOLHOLDER FOR SUPPORTING THIN ROTARY TOOLS

BACKGROUND OF THE INVENTION

In rotary grinding wheel art, it is necessary to support and carry a rotatable grinding wheel on a suitable toolholder assembly so that the wheel will not tend to fracture or crack in use. The most typical common prior art assembly utilizes a first tool ring having a clamping flange adjacently machined to a pilot diameter which fits into the bore of the wheel, and a second ring is provided likewise having a clamping flange and a short pilot diameter adjacent to the clamping flange. The two rings, typically called the "wheel collet" and "wheel flange", respectively, are clamped together against the side faces of the grinding wheel to provide a frictional grip on the wheel sides and thus transmit torque, while supporting the bore of the wheel on the respective pilot diameters. The entire grinding wheel assembly is then carried in a suitable manner on a rotatable tool spindle during the grinding process. Usually, the mass of a thick wheel is substantial enough, thus providing sufficient strength, so that the wheel will not tend to crack or be damaged in use. However, a very thin grinding wheel, in the order of ⅛ inch or so, is more susceptible to breakage, and it is desirable to provide as much bore support as is possible during the grinding process. As the wheel gets progressively thinner in design, the respective pilot diameters become very short on the supporting tool rings, so that eventually they are extremely difficult to machine and hold to precision lengths, since the combined length of the pilot diameters must be shorter than the overall width of the grinding wheel.

To avoid the problems inherent in the prior art and to provide a substantially full and continuous bore support, applicant has devised a unique tool mount wherein the circular tool support sections or pilot diameters of the respective rings are relieved to form cooperating facial teeth and tooth spaces on the two rings, so that as the rings are clamped in assembly with a grinding wheel, the tooth members of one ring enmesh with the tooth spaces of the other ring and vice versa. In such design, the tool rings are adaptable to a variety of thin width wheels, adjustably accomodating the varying width, while maintaining a substantially continuous bore support surface for the rotary tool.

SUMMARY OF THE INVENTION

The invention is shown embodied in a toolholder for supporting thin rotary tools such as grinding wheels and the like, wherein a first tool ring has a generally circular tool support pilot section and flanged shoulder portion adjacent to the support pilot section. A second tool ring has a generally circular tool support section and flanged shoulder portion adjacent to the support pilot section as well. Facial teeth are machined into the respective circular tool support pilot sections of the first and second rings, alternating with tooth spaces, so that the tooth of the one ring may be in mesh with the tooth space of the other ring and vice versa. The first tool ring is adapted for locating and driving with a rotatable tool spindle, and the second tool ring is provided with means for supporting it in a concentric manner with the first tool ring in assembly. Means are provided for clamping the rings together against a rotary tool disposed between the flanged sections of the rings, whereby a tool having a thickness equal to or less than the combined lengths of each of the tool support sections of said rings may be clamped and supported on a substantially continuous bore support surface.

DESCRIPTION OF THE PREFERRED EMBODIMENT

Figure 1:
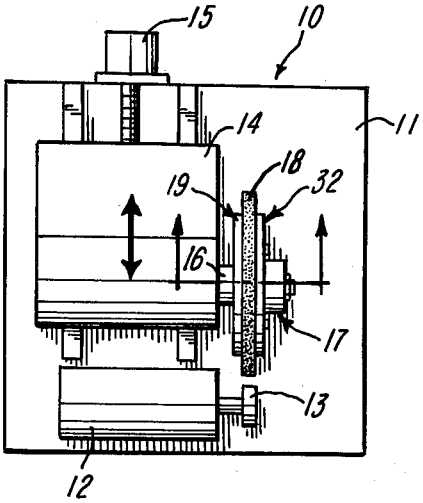
FIG. 1 is a plan view of a machine tool employing the toolholder of the present invention.

Referring to the drawings, FIG. 1 depicts a grinding machine 10 having several well-known elements, namely a machine base 11, a headstock 12 supported on the base 11 for supporting and driving a workpiece 13 of revolution during a grinding process, a wheelhead 14 slidably carried on the base 11, and movable in the directions of the arrows by a feed mechanism 15 during the grinding process. The wheelhead 14 has a rotatable grinding wheel spindle 16 which carries a toolholder assembly 17 for supporting and driving the grinding wheel 18 during the grinding cycle.

Figure 2:
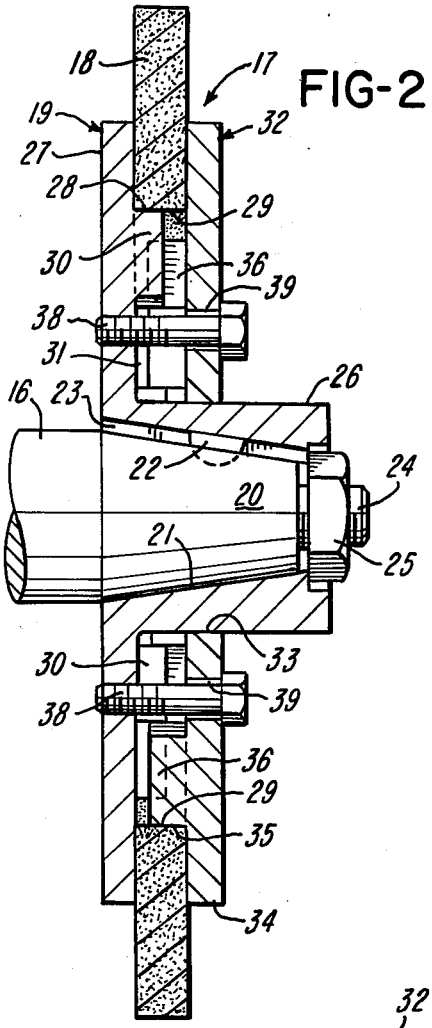
FIG. 2 is a section through the toolholder of FIG. 1 taken along the lines 2—2 of FIG. 1.

The sectional view of FIG. 2 illustrates a cutaway section through the toolholder assembly 17 of FIG. 1, wherein the wheelhead spindle 16 receives a first tool ring or collet 19 on a tapered spindle end 20 received in a cooperating tapered bore 21 of the collet 19. A spindle key 22 is received in a collet keyway 23 to provide positive driving force during the grinding process. The threaded end 24 of the spindle 16 receives a clamping nut 25 thereon to secure the collet 19 in position. The collet 19 has a central hub 26 surrounding the spindle taper, and a circular flange 27 extends radially outward from the bore 21 at one end of the collet 19. The flange 27 has a smaller diameter tool support pilot section 28 extending axially as a facial rim away from the flange 27 upon which is received the bore 29 of the grinding wheel 18. The circular tool support pilot section 28 is relieved at various points so as to form facial teeth or lugs 30, and tooth spaces 31 between the lugs 30, so that the tool support pilot section 28 becomes an intermittent bore supporting element.

A second tool ring or wheel flange 32 is carried concentrically with the collet 19, wherein the bore 33 of the wheel flange 32 is closely fitted to the hub 26. The wheel flange 32 is generally plate-like in appearance, having a circular flange 34 extending radially outward to approximately the same diameter as the flange 27 of the collet 19. A smaller diameter tool support pilot section 35 extends axially as a facial rim from the flange 34 and fits closely into the bore 29 of the grinding wheel 18. The tool support pilot section 35 is relieved at various points to provide facial teeth or lugs 36 which are cooperatingly received into the tooth spaces 31 of the collet 19, and tooth spaces 37 are provided, into which are received the lugs 30 of the collet 19. Clamping screws 38 are received through clearance holes 39 in the wheel flange 32 and extend into threadable engagement with the flange portion 27 of the collet 19 so that the two 19,34 may be drawn together into clamping engagement against the sides of the grinding wheel 18.

Figure 3:
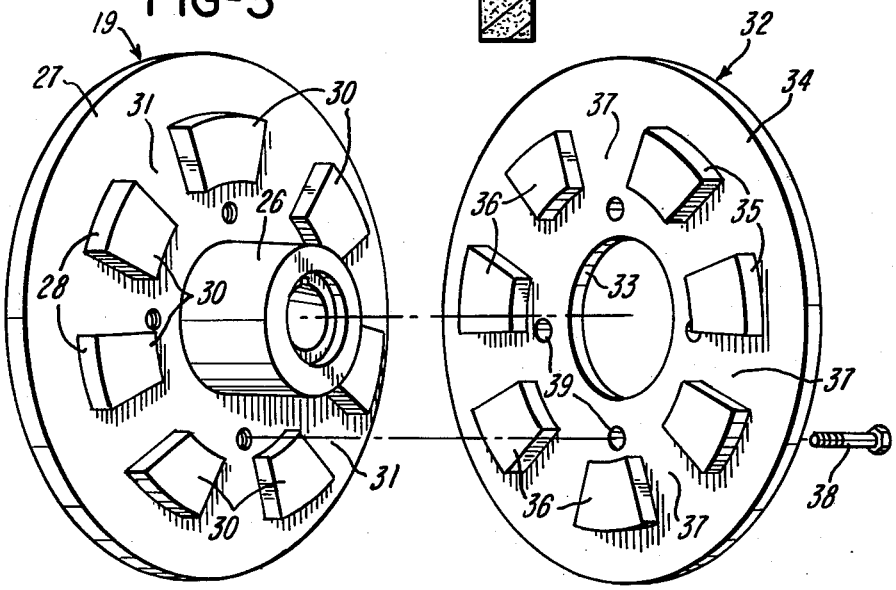
FIG. 3 is an exploded view of the toolholder elements of FIGS. 1 and 2.

FIG. 3 depicts the collet 19 and wheel flange 32 in an exploded view, wherein it may be seen that the circular tool support pilot 28 section extending from the flange 27 of the collet 19 forms facial teeth or lugs 30, and similarly, the circular tool support pilot section 35 of the wheel flange 32 extends so as to form cooperating facial teeth or lugs 36, which are intermeshed with the facial lugs 30 when the collet 19 and wheel flange 32 are clamped together by the clamp screws 38.

Here it may be noted that while straight-sided teeth or lugs 30,36 have been provided, the exact form and number of the facial lugs are generally at the discretion of the designer, so long as the two sets of lugs cooperate to form a continuous bore support section for the grinding wheel 18. Additionally, it may be appreciated that while the facial teeth or lugs extend from a generally flat smooth flange face, the flange face may be undercut or relieved slightly at the tooth space to provide additional facial clearance for the cooperating teeth of the mating member. It may be further appreciated that the toolholder permits clamping of wide tools as well as thin tools, i.e. using the same collet 27 and flange 19, without the necessity for clamping spacers.

While the invention has been shown and described in connection with the drawings and description provided, the invention is not limited to the specific embodiments shown herein, but rather extends to all such designs and modifications as come within the scope of the appended claims.

What is claimed is:

1. A toolholder for supporting thin rotary tools, comprising:

(a) a first tool ring having
  (1) a generally circular tool support section,
  (2) a flanged shoulder portion adjacent to said support section,
  (3) facial tooth means and tooth space means formed in said support section,
  (4) means for locating and driving said ring with a rotatable tool spindle;

(b) a second tool ring having
  (1) a generally circular tool support section,
  (2) a flanged shoulder portion adjacent to said support section,
  (3) facial tool means and tooth space means formed in said support section;

(c) means for supporting said first and second rings in a concentric manner with each other and with the tooth means of one ring aligned with and disposed facing the tooth space means of the other ring; and (d) means for clamping said rings together enmeshing respective tool support sections of said rings whereby a tool having a thickness equal to or less than the combined lengths of each of said tool support sections of said rings may be clamped and supported on a substantially continuous bore support surface.

* * * * *